United States Patent [19]

Hildebrant et al.

[11] 4,142,921

[45] Mar. 6, 1979

[54] HIGH TEMPERATURE ALLOY

[75] Inventors: Uwe Hildebrant, Wiesloch; Andrew R. Nicoll, Oftersheim; Peter R. Sahm, Neckargemünd, all of Fed. Rep. of Germany

[73] Assignee: BBC Brown, Boveri & Company, Limited, Baden, Switzerland

[21] Appl. No.: 904,267

[22] Filed: May 9, 1978

[30] Foreign Application Priority Data

Sep. 21, 1976 [DE] Fed. Rep. of Germany ..... 2642344

[51] Int. Cl.[2] ..... C22C 19/07

[52] U.S. Cl. ..... 148/32; 75/171

[58] Field of Search ..... 75/171, 170; 148/32, 148/32.5

[56] References Cited

U.S. PATENT DOCUMENTS 3,976,516 8/1976 Sahm ..... 75/171

*Primary Examiner*—R. Dean

*Attorney, Agent, or Firm*—Oblon, Fisher, Spivak, McClelland & Maier

[57] ABSTRACT

In a method for producing a high temperature alloy having increased creep strength, which comprises the steps of, forming a melt which consists essentially of 55–58 wt.% cobalt, 39–41 wt.% chromium, and 2.2–2.4 wt.% carbon; and solidifying said melt to obtain an alloy which is essentially a solid solution of chromium in cobalt as base alloy in which are embedded essentially parallel carbide filaments; the improvement is disclosed which comprises adding to said melt an amount of magnesium effective to deoxidize said alloy.

5 Claims, No Drawings

HIGH TEMPERATURE ALLOY

BACKGROUND OF THE INVENTION

1. Field of the Invention

The invention relates to a method of producing a high-temperature alloy with 55 to 58 wt.% cobalt, 39 to 41 wt.% chromium and 2.2 to 2.4 wt.% carbon, which is essentially a solid solution of chromium in cobalt as base alloy, in which are embedded essentially parallel carbide filaments of composition approximating $Cr_{7-x}Co_xC_3$, wherein X is between 0.2 and 3.

2. Description of the Prior Art

In the course of technical development, ever higher demands are being placed on high-temperature alloys with respect to creep strength, chiefly in gas turbine applications, where they must be able to withstand higher loads at fixed operating temperatures, or permit higher operating temperatures under constant loading.

A need therefore continues to exist for methods for producing alloys with increased creep strength at high temperatures.

SUMMARY OF THE INVENTION

Accordingly, one object of the invention is to provide a method of producing high temperature alloys having increased creep strength.

Yet another object of the invention is to provide a high temperature alloy which can withstand higher loads at fixed temperatures.

A further object of the invention is to provide a high temperature alloy which permits higher operating temperatures under constant loading.

A still further object of the invention is to provide a high temperature alloy which is particularly well adopted to use in gas turbine applications.

Briefly, these objects and other objects of the invention as hereinafter will become more readily apparent can be attained as a consequence of the inventors' discovery that a high oxygen content diminishes the creep strength of such eutectic solid solutions having a cobalt base. Elemental oxygen dissolved in the matrix causes brittleness so that under long-term mechanical-thermal loading the internal stresses in the material are poorly relieved. Furthermore, when deposited on the boundary surfaces between the carbide filaments and the matrix, elemental oxygen affects the interface energy and the bonding between filament and matrix in such a way that the long-term stability is reduced on account of accelerated deterioration of the filaments.

It has been found that magnesium is an effective deoxidizing agent for this purpose. The added magnesium binds the oxygen in the form of a finely dispersed oxide which constitutes a submicroscopic component increasing the hardness of the alloy in a suprising manner. Moreover, because of decreased melt convection (no gas evolution) during the controlled solidification, structures with fewer defects are obtained, likewise improving the strength characteristics of the alloy, in particular, the creep strength, while preserving the other desirable properties of the base alloy.

DETAILED DESCRIPTION OF THE PREFERRED EMBODIMENTS

The present invention provides a method for reducing the elemental oxygen content of the alloy, thereby preventing the delterious effects referred to above.

Starting with a melt consisting essentially of 55–58 wt.% cobalt, 39–41 wt.% chromium, and 2.2–2.4 wt.% carbon, the method of the invention comprises addition to the melt of an amount of magnesium effective to deoxidize the alloy, preferably 0.05–1.0 wt.% magnesium. Especially desirable alloy properties are obtained when 0.2 to 0.5 wt.% magnesium is added. The melt is then solidified to form the improved high temperature alloy of the invention.

Heat engine parts, and especially gas turbine components, fabricated using an alloy made according to the method of the invention are capable of withstanding higher loads at fixed temperatures as well as operating at higher temperatures under constant loading. The creep strength of these alloys, especially when the preferred range of magnesium is used, is greatly improved.

Having generally described the invention, a more complete understanding can be obtained by reference to certain specific examples, which are included for purposes of illustration only and are not intended to be limiting unless otherwise specified.

EXAMPLE

Two alloys, A and B, were prepared, with the following approximate compositions

| | | |
|---|---|---|
| Co | 56.9 | mass % |
| Co | 40.7 | mass % |
| C | 2.4 | mass % |

Alloy B differed from A in that B additionally contained magnesium whereas alloy A did not contain added magnesium. Tests of heat strength and creep time were performed, yielding the following results:

| Alloy | Heat Strength $\sigma_B$ in MPa at 1000° C | Creep time $t_B$/h at a loading of 150 MPa and 1000° C |
|---|---|---|
| A | 490 | 100 |
| B | 580 | 250 |

The comparison shows that the heat strength is greatly increased and the creep time is greatly improved by the addition of magnesium as a deoxidation agent.

Having now fully described the invention, it will be apparent to one of ordinary skill in the art that many changes and modifications can be made thereto without departing from the spirit or scope of the invention as set forth herein.

What is claimed as new and intended to be covered by letters patent is:

1. In a method for producing a high temperature alloy having increased creep strength, which comprises the steps of:
   (a) forming a melt which consists essentially of 55–58 wt.% cobalt, 39–41 wt.% chromium, and 2.2–2.4 wt.% carbon; and
   (b) solidifying said melt to obtain an alloy which is essentially a solid solution of chromium in cobalt as base alloy in which are embedded essentially parallel carbide filaments; the improvement which comprises adding to said melt an amount of magnesium effective to deoxidize said alloy.

2. The method of claim 1, wherein said amount of magnesium is from 0.05 to 1.0 wt.%.

3. The method of claim 1, wherein said amount of magnesium is from 0.2 to 0.5 wt.%.

4. The high temperature alloy produced by the method of claim 1.

5. The high temperature alloy produced by the method of claim 2.

* * * * *